US009649005B2

(12) United States Patent
Armstrong et al.

(10) Patent No.: US 9,649,005 B2
(45) Date of Patent: May 16, 2017

(54) METHOD TO REMOVE FATTY SOILS IN A DISHWASHER

(75) Inventors: Kathryn Armstrong, Grand Rapids, MI (US); Paul E. Beshears, Jr., Stevensville, MI (US)

(73) Assignee: Whirpool Corporation, Benton Harbor, MI (US)

( * ) Notice: Subject to any disclaimer, the term of this patent is extended or adjusted under 35 U.S.C. 154(b) by 991 days.

(21) Appl. No.: 12/947,127

(22) Filed: Nov. 16, 2010

(65) Prior Publication Data

US 2012/0118323 A1 May 17, 2012

(51) Int. Cl.
*A47L 15/42* (2006.01)
*A47L 15/00* (2006.01)

(52) U.S. Cl.
CPC ..... *A47L 15/0057* (2013.01); *A47L 15/0047* (2013.01); *A47L 2301/04* (2013.01); *A47L 2401/22* (2013.01); *A47L 2501/30* (2013.01); *A47L 2501/34* (2013.01); *A47L 2501/36* (2013.01)

(58) Field of Classification Search
CPC ..... A47L 15/0057; A47L 2401/22; A47L 2501/34; A47L 15/0047; A47L 2501/30; A47L 2501/36; A47L 2301/04
USPC ..... 134/18
See application file for complete search history.

(56) References Cited

U.S. PATENT DOCUMENTS

| | | | | |
|---|---|---|---|---|
| 6,551,414 | B2 * | 4/2003 | Reichold | 134/18 |
| 2008/0308127 | A1 * | 12/2008 | Padtberg et al. | 134/18 |
| 2009/0078289 | A1 * | 3/2009 | Son et al. | 134/18 |
| 2009/0151751 | A1 | 6/2009 | Bragg | |
| 2009/0250085 | A1 * | 10/2009 | Gaus et al. | 134/56 D |

FOREIGN PATENT DOCUMENTS

| | | | |
|---|---|---|---|
| DE | 19902812 | A1 | 7/2000 |
| JP | 2002177190 | A | 6/2002 |
| JP | 2010036023 | A | 2/2010 |

* cited by examiner

*Primary Examiner* — Katelyn Whatley

(57) ABSTRACT

A method of operating a dishwasher by controlling the use of hot liquids to dissolve fatty soils.

9 Claims, 3 Drawing Sheets

METHOD TO REMOVE FATTY SOILS IN A DISHWASHER

BACKGROUND OF THE INVENTION

Contemporary automatic dishwashers for use in a typical household include a tub at least partially defining a treating chamber within which is provided a rack for supporting utensils within the tub. A recirculation system is provided for recirculating treating liquid throughout the tub to remove soils from the utensils. The dishwasher may have a controller that implements a number of pre-programmed cycles of operation, which may operate at various temperatures, to treat utensils contained in the tub.

SUMMARY OF THE INVENTION

The invention relates to a method of operating a dishwasher having both cool cycles of operation and hot cycles of operation, where the cool cycles of operation have cool liquid temperatures, insufficient to dissolve fatty soils, and hot cycles of operation have hot liquid temperatures, sufficient to dissolve fatty soils, the method includes storing in a memory associated with the controller, a running count of the number of sequentially selected cool cycles and when the count satisfies a predetermined threshold count, using a hot liquid in a subsequent cycle of operation, regardless of whether the subsequent cycle of operation is a cool cycle of operation or a hot cycle of operation.

DESCRIPTION OF AN EMBODIMENT OF THE INVENTION

Figure 1:
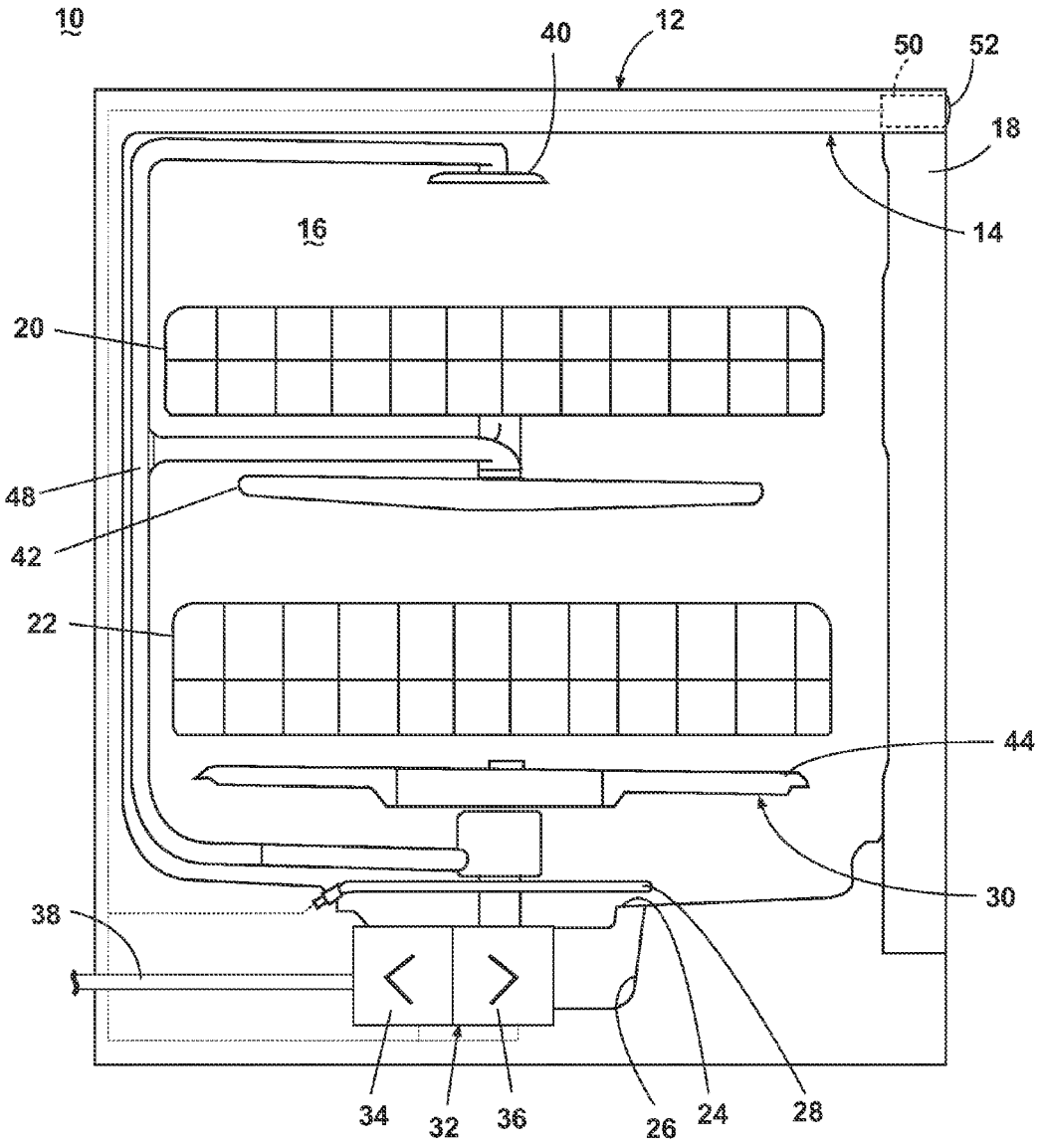
FIG. 1 is a schematic view of a dishwasher according to one embodiment of the invention.

FIG. 1 is a schematic illustration of an automatic dishwasher 10 in accordance with a first embodiment of the invention. The dishwasher 10 shares many features of a conventional automatic dishwasher, which will not be described in detail herein except as necessary for a complete understanding of the invention. While the present invention is described in terms of a conventional dishwashing unit, it could also be implemented in other types of dishwashing units, such as in-sink dishwashers or drawer-type dishwashers.

As illustrated, the dishwasher 10 includes a chassis 12 which contains a wash tub 14 that partially defines a treating chamber 16 with an access opening in the form of an open face. A cover, illustrated as a door 18, may be hingedly mounted to the chassis 12 and may move between an opened position, wherein the user may access the treating chamber 16, and a closed position, as shown in FIG. 1, wherein the door 18 covers or closes the open face of the treating chamber 16 in a conventional fashion.

Utensil holders in the form of upper and lower racks 20, 22 are located within the treating chamber 16 and receive utensils for being treated. The racks 20, 22 are typically mounted for slidable movement in and out of the treating chamber 16 for ease of loading and unloading. As used in this description, the term "utensil(s)" is intended to be generic to any item, single or plural, that may be treated in the dishwasher 10, including, without limitation; dishes, plates, pots, bowls, pans, glassware, and silverware.

A bottom wall 24 of the dishwasher 10 may be sloped to define a lower tub region in which is formed a sump 26. A heater 28 may be located within or near the sump 26 for heating liquid contained in the sump 26.

A liquid circulation system 30 may also be included in the dishwasher 10 for supplying, recirculating, and spraying liquid and treating chemistry, such as detergents, rinse aids, and the like, throughout the treating chamber 16. The liquid circulation system 30 may include a pump assembly 32, which may be located in or around a portion of the bottom wall 24 and may be in fluid communication with the sump 26. The pump assembly 32 may include both a drain pump 34 and a recirculation pump 36. The pump assembly 32 may have a motor, which provides it power (not shown).

The drain pump 34 may draw liquid from the sump 26 and pump the liquid out of the dishwasher 10 to a household drain line 38. The recirculation pump 36 may draw liquid from the sump 26 and pump the liquid to sprayers 40, 42, 44. As illustrated, liquid may be supplied to the sprayers 40 and 42 through a supply tube 48 that extends generally rearwardly from the recirculation pump 38 and upwardly along a rear wall of the tub 14. While the supply tube 48 ultimately supplies liquid to the sprayers 40, 42, it may fluidly communicate with one or more manifold tubes that directly transport liquid to the sprayers 40, 42.

Sprayer 40 is located above the upper rack 20 and is illustrated as a fixed spray nozzle that sprays liquid downwardly within the treating chamber 16. Sprayers 42, 44 are located, respectively, beneath upper rack 20 and lower rack 22 and are illustrated as rotating spray arms. The upper spray arm 42 may be rotatably mounted to the bottom of the upper rack 20 and may provide a liquid spray upwardly through the bottom of the upper rack 20. The lower spray arm 44 may be rotatably mounted to the recirculation pump 36 beneath the lower rack 22 and may provide a liquid spray upwardly through the bottom of the lower rack 22. The upper spray arm 42 may optionally also provide a liquid spray downwardly onto the lower rack 22, but for purposes of simplification, this will not be illustrated herein. The dishwasher 10 may further include other conventional components such as additional spray arms or nozzles, a filter, a treating chemistry dispenser, etc.; however, these components are not germane to the present invention and will not be described further herein.

A controller 50 may also be included in the dishwasher 10, which may be operably coupled to various components of the dishwasher 10 to implement a cycle of operation. A control panel or user interface 52 provided on the dishwasher 10 and coupled to the controller 50 may be used to select a cycle of operation. The user interface 52 may include operational controls such as dials, lights, switches, and displays enabling a user to input commands to the controller 50 and receive information. Alternately, the treating cycle may be automatically selected by the controller 50 based on soil levels sensed by the dishwasher 10 to optimize the performance of the dishwasher 10 for a particular load of utensils.

Figure 2:
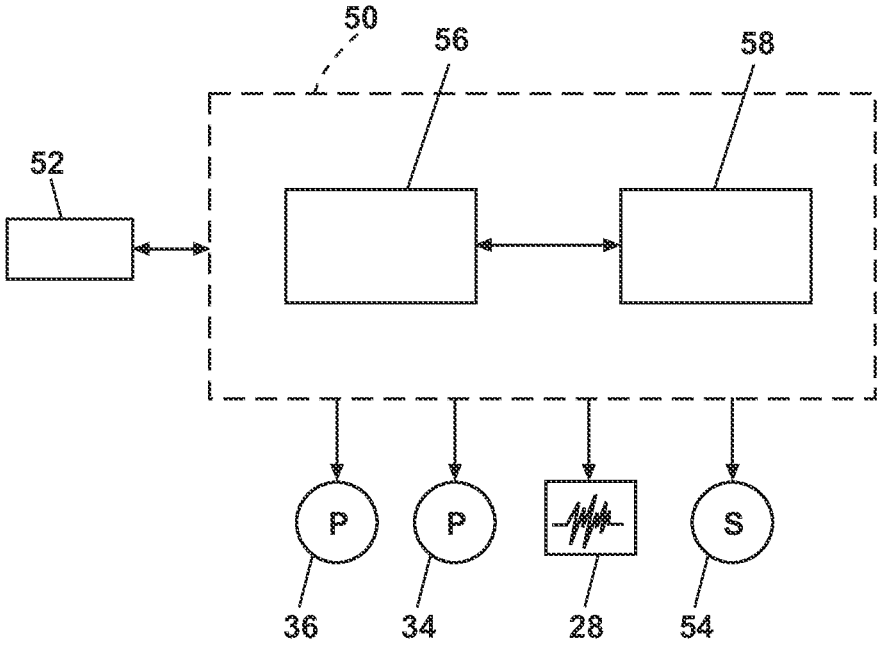
FIG. 2 is a schematic view of a controller of the dishwasher of FIG. 1.

As illustrated in FIG. 2, the controller 50 may be coupled with the recirculation pump 36 for circulation of liquid in the treating chamber 16 and the drain pump 34 for drainage of liquid from the dishwasher 10. The controller 50 may also be operably coupled with the heater 28 to heat the liquid within the wash tub 14 depending on the cycle of operation. The controller 50 may also receive inputs from one or more other additional sensors 54, examples of which are known in the art. Non-limiting examples of sensors that may be communicably coupled with the controller 50 include a temperature sensor and a turbidity sensor to determine the soil load associated the utensils within the dishwasher 10.

The controller 50 may also be provided with memory 56 and a central processing unit (CPU) 58. The memory 56 may be used for storing control software that may be executed by the CPU 58 in completing a cycle of operation of the dishwasher 10 and any additional software. For example, the memory 58 may store one or more pre-programmed cycles of operation that may be selected by a user. Examples of cycles of operation include normal, light/china, heavy/pots and pans, and rinse only. Such cycles may include both hot cycles of operation and cool cycles of operation. As used in this description, the term "cool cycles of operation" have cool liquid temperatures, which are insufficient to dissolve some fatty soils. By way of non-limiting example, a cool cycle of operation may include a cool wash, which may be run at 95° F. and a cool rinse, which may be run at 115° F. As used in this description, the term "hot cycles of operation" have hot liquid temperatures, which are sufficient to dissolve fatty soils. By way of non-limiting example, a hot cycle of operation may include a hot wash, which may be run at 105° F. and a hot rinse may be run anywhere between 120° F.-140° F. Alternatively, a hot cycle of operation may be a cleanout cycle which may be run at a temperature between 120° F.-140° F.

In general, during operation of the dishwasher 10, the controller 50 may be operably coupled with one or more components of the dishwasher 10 for communicating with and controlling the operation of the component to complete a cycle of operation, which may include either a cool cycle of operation or a hot cycle of operation. For example, the controller 50 may be operably coupled with at least the drain pump 34, recirculation pump 36, and the heater 28 to control the operation of these and other components to implement one or more of the cycles of operation.

More specifically, liquid may be supplied from a liquid source (not shown) and the recirculation pump 36 may be operated to supply liquid from the sump 26 to the sprayers 40, 42, 44 to spray utensils located in the treating chamber 16. Depending on the phase being performed in the cycle of operation, the heater 28 may be operated during this time to heat the liquid in the sump 26. This heated liquid may then be recirculated by the recirculation pump 36 to apply heated liquid to the utensils in the treating chamber 16. During the cycle of operation the drain pump 32 may be actuated to draw liquid, either heated or not, and soils from the sump 26 and direct them to the household drain line 38.

Current dishwasher technologies rely on thermal, mechanical, and chemical energy, such as detergents, to clean utensils and remove high melting point fatty soils. Energy reduction requirements, especially electrical energy, have driven down the liquid temperatures that are used to accomplish the cleaning action in dishwashers. It may be more difficult to remove fatty soils with cooler liquid and the fatty soils have a tendency to build up on cooler parts of the dishwasher, such as the various conduits of the liquid circulation system, where flow rates may be restricted.

Figure 3:
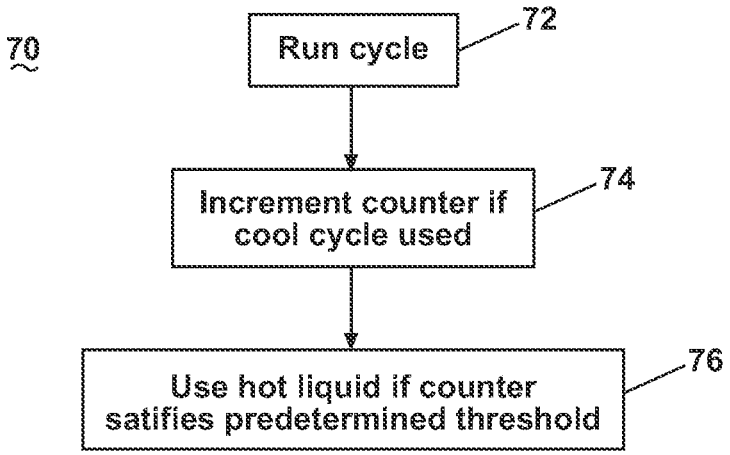
FIG. 3 is a flow chart illustrating a method for operating a dishwasher according to a second embodiment of the invention.

The previously described dishwasher 10 may be used to implement one or more embodiments of a method of the invention designed to address the build up of fatty soils. Referring now to FIG. 3, a flow chart of one embodiment of a method 70 for operating the dishwasher 10 to remove a buildup of fatty soils is illustrated. The method 70 starts with assuming that the user has placed utensils within the treating chamber 16 for treatment and selected a cycle of operation through the user interface 52.

The method 70 may begin at 72 and may be initiated automatically at the start of a user selected cycle of operation or at the start of a cycle of operation selected by the controller 50. It has been contemplated that a running count of the number of sequentially selected cool cycles may be stored in the memory 56 of the controller 50. It is illustrated at 74 that if the cycle of operation selected is a cool cycle, then the counter is increased by 1. In this manner, the controller 50 may keep a running count or total of the number of sequentially run cool cycles.

When it is determined by the controller 50 that the running count satisfies a predetermined threshold, hot liquid is used in a subsequent cycle of operation at 76. The running count may satisfy a predetermined threshold count when the running count is greater than or equal to the predetermined threshold count. The predetermined threshold count may be determined experimentally and stored in the memory 56 of the controller 50.

The subsequent cycle of operation, where the hot liquid is used, may be the cycle of operation immediately after the count satisfies the predetermined threshold. Alternatively, it has been contemplated that the subsequent cycle of operation, where hot liquid is used, may be within some predetermined number of subsequent cycles of operation, such as within the next three cycles of operation after the running count satisfies the predetermined threshold. It has been contemplated that the use of the hot liquid in the subsequent cycle of operation may be deferred if the hot liquid may be deleterious to the user selected cycle, such as when fine china or other similar materials are being washed.

Further, the subsequent cycle of operation, wherein the hot liquid is used, may be either selected by the user or selected and implemented by the controller 50. It has been contemplated that the hot liquid may be used in the subsequent cycle regardless of whether the subsequent cycle of operation is selected as being a cool cycle of operation or a hot cycle of operation. For example, if a cool cycle of operation is selected as the cycle of operation for the subsequent cycle, it has been contemplated that using the hot liquid in that cycle may include heating the liquid used in the cool cycle of operation such that hot liquid temperatures are achieved during at least a portion of the selected cool cycle of operation. Alternatively, if a cool cycle of operation is selected as the cycle of operation for the subsequent cycle, it may be entirely replaced with a hot cycle of operation. Further, if a hot cycle of operation is selected as the subsequent cycle of operation, then the using the hot liquid in the subsequent cycle may include merely using the hot liquid in the selected hot cycle of operation without change. Further, it is contemplated that the use of the hot liquid may occur in any portion of the subsequent cycle such as during a wash phase or a rinse phase.

After the hot liquid is used in the subsequent cycle the running counter may be reset. More specifically, the counter may be set to 0 to indicate that no cool cycles of operation have run since the last hot cycle of operation. Further, it has been contemplated that the resetting of the running count may occur whenever a hot cycle of operation is selected by the user or whenever a hot cycle of operation is implemented by the controller 50 regardless of whether that cycle of operation is the subsequent cycle of operation or not.

The method 70 provides a reliable method for operating the dishwasher 10 to remove any buildup of fatty soils within the dishwasher 10 and within conduits leading to the household drain line 38, which may have occurred due to the use of cooler water temperatures. The method provides for the use of hot liquid at a predetermined interval to achieve the removal of fatty soil buildup from the dishwasher 10 itself and its related conduits to aid in maintaining the cleaning efficiency of the dishwasher 10. Further, if the hot liquid is drained then any buildup of fatty soils in the conduits leading to the household drain line 38 will also be removed and this will aid in keeping the conduits clean so that they are less likely to clog and cause drainage issues.

Figure 4:
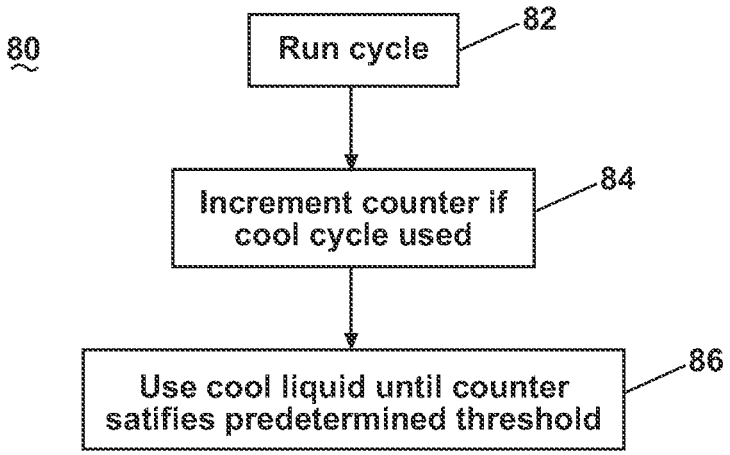
FIG. 4 is a flow chart illustrating a method for operating a dishwasher according to a third embodiment of the invention.

Referring now to FIG. 4, a flow chart of another embodiment of a method 80 for operating the dishwasher 10 to remove a buildup of fatty solids is illustrated. The method 80 is almost identical to the method 70 in that a count of sequentially run cool cycles is kept and that a hot liquid is used in a subsequent cycle after the running count meets a predetermined count threshold, regardless of whether the subsequent cycle of operation is a cool cycle of operation or a hot cycle of operation. However, the method 80 differs from the method 70 in that it takes energy savings further and at 86 maintains liquid temperatures below the hot liquid temperature for all implemented cycles of operation except the subsequent cycle of operation, regardless of whether a cool cycle of operation or hot cycle of operation is selected. More specifically, if a user selects a hot cycle of operation and the controller 50 determines that the cycle is not the subsequent cycle and thus a hot cycle of operation does not need to be run to remove a buildup of fatty soils, then a cool cycle of operation will be run instead. It has been contemplated that in the method 80 a cool cycle may replace a hot cycle of operation which has been selected or cooler temperature liquids in general may be used during the selected cycle of operation to reduce energy consumption.

A majority of energy consumption of current dishwashers goes to heat liquid in the dishwasher and the method 80 provides a method for reducing the need to heat liquid within the dishwasher 10 until it is deemed necessary by the controller 50 to remove any buildup of fatty soils. The method 80 results in the ability to conserve energy and to only use hot liquid during the subsequent cycle of operation, when it is necessary to remove the buildup of fatty soils from the dishwasher 10 and its related conduits. After the implementation of the subsequent cycle of operation, wherein the hot liquid is used, the controller 50 once again uses cool liquid and maintains the liquid temperatures below the hot liquid temperature for all selected cycles of operation, regardless of whether a cool or hot cycle of operation is selected until the running count meets the predetermined count threshold and the next subsequent cycle of operation is run.

While the invention has been specifically described in connection with certain specific embodiments thereof, it is to be understood that this is by way of illustration and not of limitation, and the scope of the appended claims should be construed as broadly as the prior art will permit.

What is claimed is:

1. A method of operating a dishwasher including a treating chamber for receiving dishes and having both a cool cycle of operation and a hot cycle of operation, which may be implemented in the treating chamber and that may be selected by a user and implemented by a controller, where the cool cycle of operation has a cool liquid temperature insufficient to dissolve fatty soils, and the hot cycle of operation has a hot liquid temperature sufficient to dissolve fatty soils, the method comprising:

maintaining liquid temperatures within the treating chamber below the hot liquid temperature for all implemented cycles of operation, regardless of whether the cool or hot cycle of operation is selected;

storing in a memory associated with the controller, a running count of the number of cycles of operation implemented within the treating chamber with liquid temperatures below the hot liquid temperature; and when the count satisfies a predetermined threshold count, using a liquid with a hot liquid temperature within the treating chamber when a subsequent cycle of operation is implemented, regardless of whether the subsequent cycle of operation is selected as the cool cycle of operation or the hot cycle of operation.

2. The method of claim 1, further comprising after the implementing of the subsequent cycle of operation, maintaining liquid temperatures below the hot liquid temperature for all implemented cycles of operation, regardless of whether a cool or hot cycle of operation is selected.

3. The method of claim 1, further comprising resetting the running count when the subsequent cycle of operation is implemented.

4. The method of claim 1 wherein the subsequent cycle of operation is the cycle of operation immediately after the running count satisfies the predetermined threshold.

5. The method of claim 1 wherein the running count is satisfied when the running count is greater than or equal to the predetermined threshold.

6. The method of claim 1 wherein when the subsequent cycle of operation is a hot cycle of operation, the using the liquid with the hot liquid temperature comprises implementing the hot cycle of operation.

7. The method of claim 1 wherein when the subsequent cycle of operation is selected as a cool cycle of operation, the using the liquid with the hot liquid temperature comprises replacing the selected cool cycle with a hot cycle of operation.

8. A method of operating a dishwasher including a treating chamber for receiving dishes and having both cool cycles of operation and hot cycles of operation, which may be implemented in the treating chamber and that may be selected by a user and implemented by a controller, where the cool cycles of operation have cool liquid temperatures, insufficient to dissolve fatty soils, and the hot cycles of operation have hot liquid temperatures, sufficient to dissolve fatty soils, the method comprising:

maintaining liquid temperatures within the treating chamber below the hot liquid temperature for all implemented cycles of operation, regardless of whether a cool or hot cycle of operation is selected;

storing in a memory associated with the controller, a running count of the number of cycles of operation implemented within the treating chamber with liquid temperatures below the hot liquid temperature; and when the count satisfies a predetermined threshold count and when hot liquid is not deleterious to a user selected cycle, using a liquid with a hot liquid temperature within the treating chamber when a subsequent cycle of operation is implemented, regardless of whether the subsequent cycle of operation is a cool cycle of operation or a hot cycle of operation.

9. The method of claim 8 wherein when the count satisfies the predetermined threshold count and the hot liquid is deleterious to the user selected cycle, deferring the use of the hot liquid to a subsequent cycle of operation where the hot liquid is not deleterious to the user selected cycle.

* * * * *